US007239086B2

(12) United States Patent
Yuki et al.

(10) Patent No.: US 7,239,086 B2
(45) Date of Patent: Jul. 3, 2007

(54) PLASMA DISPLAY PANEL INCLUDING DIELECTRIC LAYER THAT DOES NOT COVER PART OF A DISCHARGE GAP

(75) Inventors: Haruhiro Yuki, Shijonawate (JP); Yoshiyasu Honma, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 64 days.

(21) Appl. No.: 10/608,387

(22) Filed: Jun. 30, 2003

(65) Prior Publication Data

US 2004/0155584 A1 Aug. 12, 2004

(30) Foreign Application Priority Data

Jul. 1, 2002 (JP) ..... 2002-191940

(51) Int. Cl.
*H01J 17/49* (2006.01)

(52) U.S. Cl. ..... 313/586; 313/581; 313/582; 313/584; 313/602; 345/60

(58) Field of Classification Search ..... 313/582–587, 313/292; 445/24; 315/169.3
See application file for complete search history.

(56) References Cited

U.S. PATENT DOCUMENTS 6,043,605 A * 3/2000 Park ..... 313/586
6,376,995 B1 * 4/2002 Kato et al. ..... 315/169.3
6,483,491 B1 * 11/2002 Lee ..... 345/60
6,525,470 B1 * 2/2003 Amemiya ..... 313/586
6,670,757 B2 * 12/2003 Kato et al. ..... 313/587

FOREIGN PATENT DOCUMENTS

| | | | |
|---|---|---|---|
| JP | 2000-123746 | | 4/2000 |
| JP | 2000-285811 | | 10/2000 |
| JP | 2000-305516 | | 11/2000 |
| JP | 2001006562 | A * | 1/2001 |
| KR | 2001004231 | A * | 1/2001 |
| KR | 2001058561 | A * | 7/2001 |
| KR | 2001058562 | A * | 7/2001 |
| KR | 2003037219 | A * | 5/2003 |

* cited by examiner

*Primary Examiner*—Sikha Roy
(74) *Attorney, Agent, or Firm*—Wenderoth, Lind & Ponack, L.L.P.

(57) ABSTRACT

An AC type plasma display panel includes a plurality of pairs of display electrodes, a dielectric layer, a data electrode and a float electrode. A pair of the plurality of pairs of display electrodes are disposed parallel to each other on a front substrate and form a discharge gap for emitting light for display. The dielectric layer is formed on the front substrate and covers the plurality of pairs of display electrodes excluding at least a part of the discharge gap. The data electrode is disposed on a rear substrate, which is placed facing the front substrate across a discharge space, in a manner to cross under the display electrodes. The float electrode is disposed at the discharge gap on the front substrate.

10 Claims, 4 Drawing Sheets

PLASMA DISPLAY PANEL INCLUDING DIELECTRIC LAYER THAT DOES NOT COVER PART OF A DISCHARGE GAP

FIELD OF THE INVENTION

The present invention relates to a plasma display panel which can display an image with high brightness and high efficiency.

BACKGROUND OF THE INVENTION

A plasma display panel is a display device having superior visibility and characterized by its thinness, lightness and large display. The plasma display panels are classified into two driving systems, i.e., an AC type and a DC type, and classified into two electric discharge systems, i.e., a surface discharge type and an opposed discharge type. The AC and surface discharge type plasma display panel is becoming a mainstream, because it is suitable for high resolution and is easy to manufacture.

However, brightness and luminous efficiency of plasma display panels remain low, so that current plasma display panels have only approximately ⅓ the luminous efficiency of a CRT, which is popular as a display apparatus. Accordingly, various plasma display panels have been developed for the purpose of high brightness and high efficiency.

In general, the luminous efficiency of the plasma display panel is known to increase as the space (i.e., a discharge gap) between electrodes for generating discharge increases. For example, Japanese Patent Unexamined Publication No. 2000-305516 discloses an example of a plasma display panel having two times higher luminous efficiency by forming a three to five times larger discharge gap than usual. FIG. 8 is a sectional view of a plasma display panel having high luminous efficiency by forming a large discharge gap. The discharge gap between display electrodes 62 (i.e., a pair of bus electrodes 62*a* and 62*b*), which are disposed parallel to each other on front substrate 60, is formed larger (e.g., 400 μm to 500 μm). Dielectric layer 65 and protective layer 66 are formed in a manner to cover display electrodes 62. A plurality of parallel data electrodes 74 are disposed on rear substrate 70, and dielectric layer 75 covers both of them. A plurality of barrier ribs are disposed thereon parallel to data electrodes 74, and phosphor layer 77 is formed on a surface of dielectric layer 75 and sides of the barrier rib. Front substrate 60 and rear substrate 70 are faced and stuck to each other in a manner that display electrodes 62 cross over data electrodes 74, and discharge gas is sealed into discharge space therebetween. In the plasma display panel discussed above, when a voltage is applied to display electrodes 62, plasma discharge with high luminous efficiency is generated through the large discharge gap.

However, a size of a pixel is determined by the necessary number of pixels and a screen size of the display device, so that the size of the discharge gap is restricted by the size of the pixel and can not be freely enlarged. For example, in a 42 inch plasma display used for a standard television image receptor, the size of one pixel becomes approximately 1 mm, whereby the size of the discharge gap is restricted to at most approximately 500 μm. In the future, according to high resolution of the plasma display panel, the size of the pixel tends to be smaller, so that the method of increasing luminous efficiency by enlarging the discharge gap will reach the limits. In addition, according to the high resolution, a luminous area of the plasma display panel is reduced, so that deterioration of brightness is anticipated. Therefore, higher brightness and higher efficiency are necessary for high resolution.

The present invention is directed to solve the problems discussed above, and an object of the present invention is to provide a plasma display panel with high brightness and high luminous efficiency.

SUMMARY OF THE INVENTION

A plasma display panel of this invention includes the following elements:

- a plurality of pairs of display electrodes, wherein a pair of the plurality of pairs of display electrodes are disposed parallel to each other on a front substrate and form a discharge gap for emitting light for display, and
- a dielectric layer, which is formed on the front substrate and covers the plurality of pairs of display electrodes excluding at least a part of the discharge gap.

DETAILED DESCRIPTION OF THE PREFERRED EMBODIMENTS

Plasma display panels of exemplary embodiments of the present invention are demonstrated hereinafter with reference to the accompanying drawings.

First Embodiment

Figure 1:
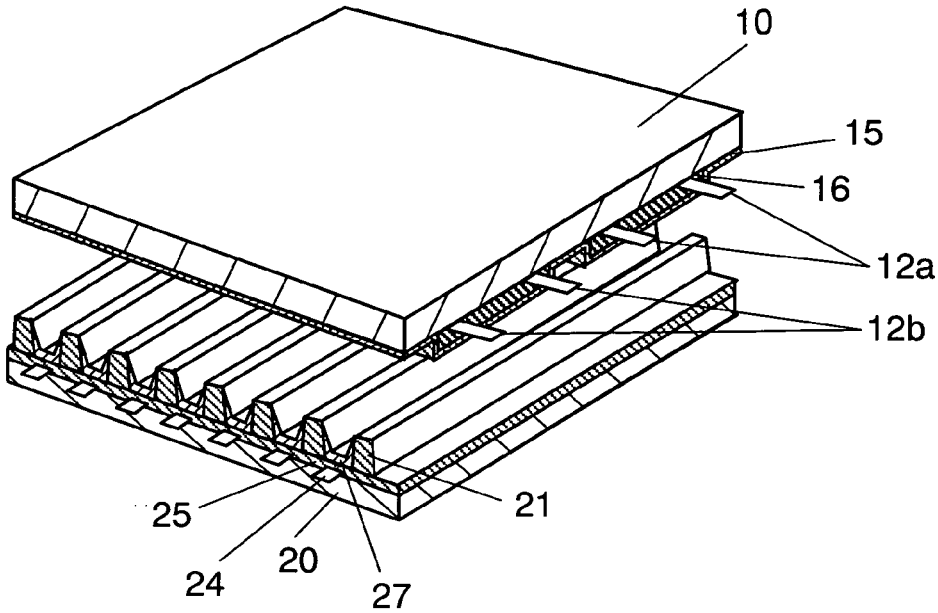
FIG. 1 is an exploded perspective view showing a structure of a plasma display panel in accordance with a first exemplary embodiment of the present invention.
Figure 2:
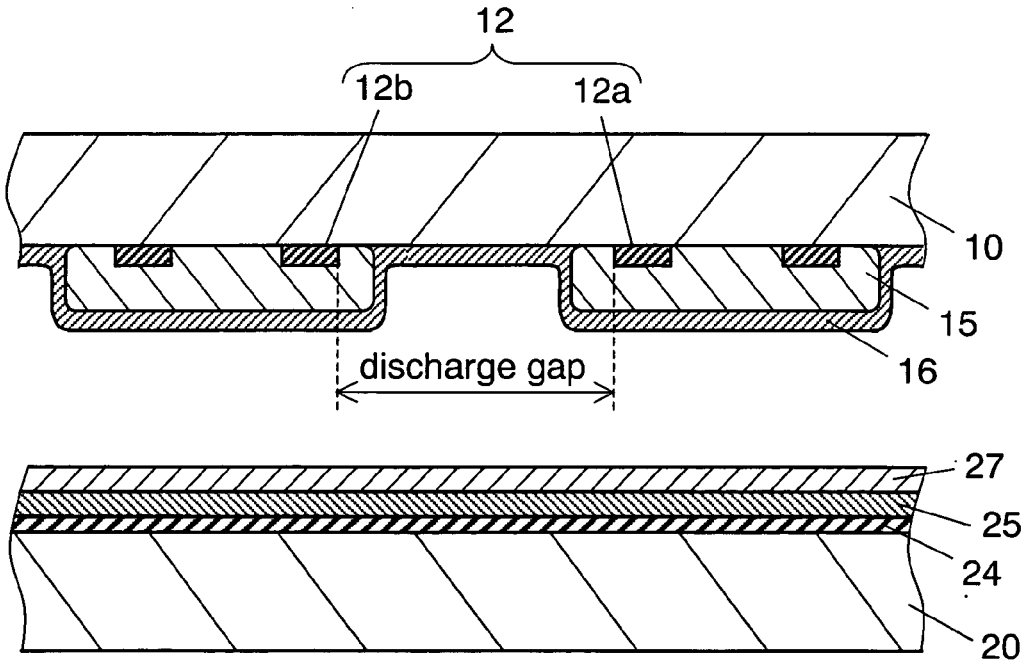
FIG. 2 is a sectional view showing the structure of the plasma display panel in accordance with the first exemplary embodiment of the present invention.

FIG. 1 is an exploded perspective view showing a structure of a plasma display panel in accordance with the first exemplary embodiment of the present invention. FIG. 2 is a sectional view showing the structure of the plasma display panel in accordance with the first exemplary embodiment of the present invention.

Display electrodes 12 (i.e., a pair of display electrodes 12*a* and 12*b*) are disposed parallel to each other on front substrate 10, thereby forming a discharge gap for emitting light for display. Each of display electrodes 12*a* and 12*b* is covered with dielectric layer 15. However, the discharge gap formed between display electrodes 12*a* and 12*b* is not covered with dielectric layer 15. Protective layer 16 covers dielectric layer 15 and the discharge gap. In other words, the discharge gap is not covered with dielectric layer 15, and is directly covered with protective layer 16.

A plurality of data electrodes 24 and barrier ribs 21 are alternately disposed on rear substrate 20, which is placed facing front substrate 10 across a discharge space, in a manner to cross under display electrodes 12. Dielectric layer 25 is laminated on data electrodes 24, and phosphor layer 27 is applied to an area surrounded by dielectric layer 25 and barrier ribs 21. Discharge gas is sealed into the discharge space between front substrate 10 and rear substrate 20.

Thus, the plasma display panel has a structure in which a plurality of discharge cells are two dimensionally arranged, where a discharge cell of the plurality of discharge cells includes intersections of a pair of display electrodes 12 and data electrodes 24.

Figure 3:
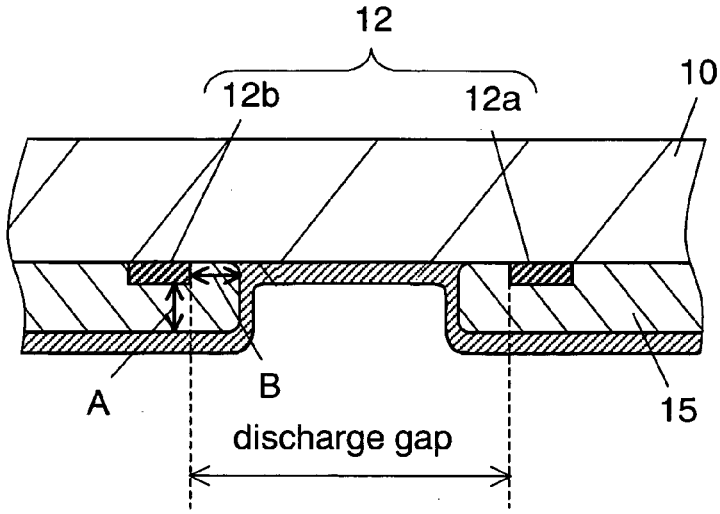
FIG. 3 is an enlarged view showing a structure of a discharge gap of the plasma display panel in accordance with the first exemplary embodiment of the present invention.

FIG. 3 is an enlarged view showing the structure of the discharge gap of the plasma display panel in accordance with the first exemplary embodiment of the present invention. In the first embodiment, a width of the discharge gap between display electrodes 12*a* and 12*b* is designed to be 500 μm, and a width of a portion where dielectric layer 15 is not formed in the discharge gap is designed to be 460 μm. Thickness B of dielectric layer 15 in a direction where display electrodes 12*a* and 12*b* face each other is designed to be 20 μm. Thickness A of dielectric layer 15 in a direction where display electrodes 12*a* and 12*b* face rear substrate 20 is designed to be 30 μm. Thickness A is designed equal to or thicker than thickness B.

These numerals mentioned above have been designed with a 42 inch VGA type plasma display in mind, however, the numerals are required to be optimized according to a screen size, resolution, a specification, a driving method or the like of a plasma display.

Figure 4:
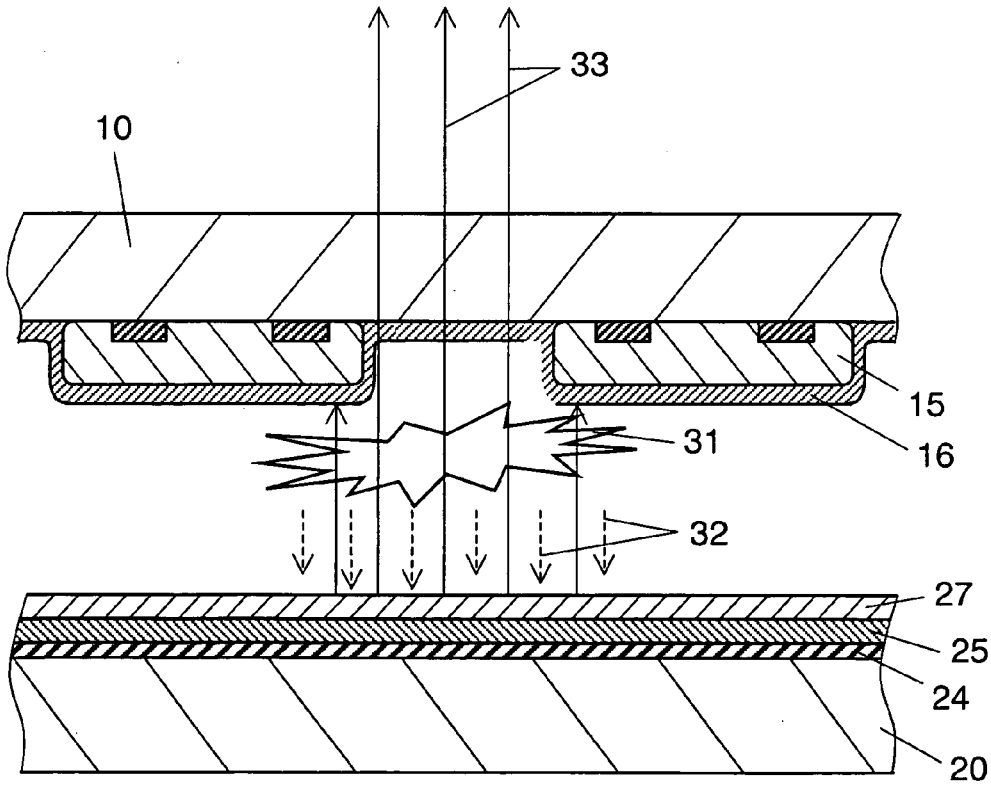
FIG. 4 shows a working of the plasma display panel in accordance with the first exemplary embodiment of the present invention.

FIG. 4 shows a working of the plasma display panel in accordance with the first exemplary embodiment of the present invention. A voltage higher than a discharge-starting voltage is applied between display electrodes 12*a* and 12*b* for allowing the plasma display to emit light. Dielectric breakdown is generated at the discharge space, so that the sealed discharge gas is put in a plasma condition 31. When excited xenon returns to a stable condition, ultraviolet light 32 is generated. Ultraviolet light 32 is converted into three visible lights, i.e., red light, green light and blue light, at phosphor layer 27. Visible light 33 generated at each discharge space is transmitted through front substrate 10, whereby a color image is displayed on the plasma display panel. The discharge gap of the plasma display panel in the first embodiment is designed to be large, i.e., 500 μm, so that the panel has high luminous efficiency and generates visible light with high brightness on phosphor layer 27.

However, visible light 33 generated on phosphor layer 27 has to pass through protective layer 16, dielectric layer 15 and front substrate 10, till visible light 33 is transmitted outside the plasma display panel, where protective layer 16 and dielectric layer 15 are formed on front substrate 10. In the first embodiment, protective layer 16 is made of MgO thin film having a thickness of approximately 600 nm and a visible light transmittance of approximately 90%, and dielectric layer 15 is made of low-melting glass having a thickness of approximately 30 μm and a visible light transmittance of approximately 80%. In addition, front substrate 10 is made of tempered glass having a thickness of approximately 2.8 mm and a visible light transmittance of approximately 90%. As mentioned above, because the visible light transmittance of the dielectric layer is low, when the discharge gap is covered with dielectric layer 15, the visible light generated on the phosphor layer attenuates through protective layer 16, dielectric layer 15 and front substrate 10. Therefore, the entire light transmittance becomes 65%.

However, the plasma display panel in the first embodiment does not have dielectric layer 15 at the discharge gap formed between display electrodes 12*a* and 12*b* of each discharge cell. Thus, the visible light generated on the phosphor layer attenuates through protective layer 16 and front substrate 10. Therefore, the entire light transmittance becomes 81%. In other words, in a conventional plasma display panel, brightness of the visible light converted at phosphor layer 27 is reduced by absorption of dielectric layer 65 on front substrate 60. However, the plasma display panel of this invention can prevent reducing of brightness by making an area, where dielectric layer 15 is not formed, at the discharge gap. The ratio of the entire light transmittance of the conventional panel to the panel of this invention is 1.26, i.e., this invention has an effect of increasing brightness by 26%. Accordingly, this invention improves brightness without increasing electric power, thereby providing a high brightness, high efficiency display screen.

As discussed above, the plasma display panel in the first embodiment is designed in a manner that the discharge gap becomes large, thereby generating electric discharge with high efficiency. In addition, the dielectric layer is not formed at the discharge gap, whereby the visible light generated on phosphor layer 27 hardly attenuates and can be transmitted outside the plasma display panel. As a result, brightness is improved without increasing electric power, thereby realizing higher efficiency. Besides, thickness A is designed to be equal to or thicker than thickness B. As a result, discharge is also generated in the direction where display electrodes face each other, whereby brightness is improved using this discharge.

Second Embodiment

Figure 5:
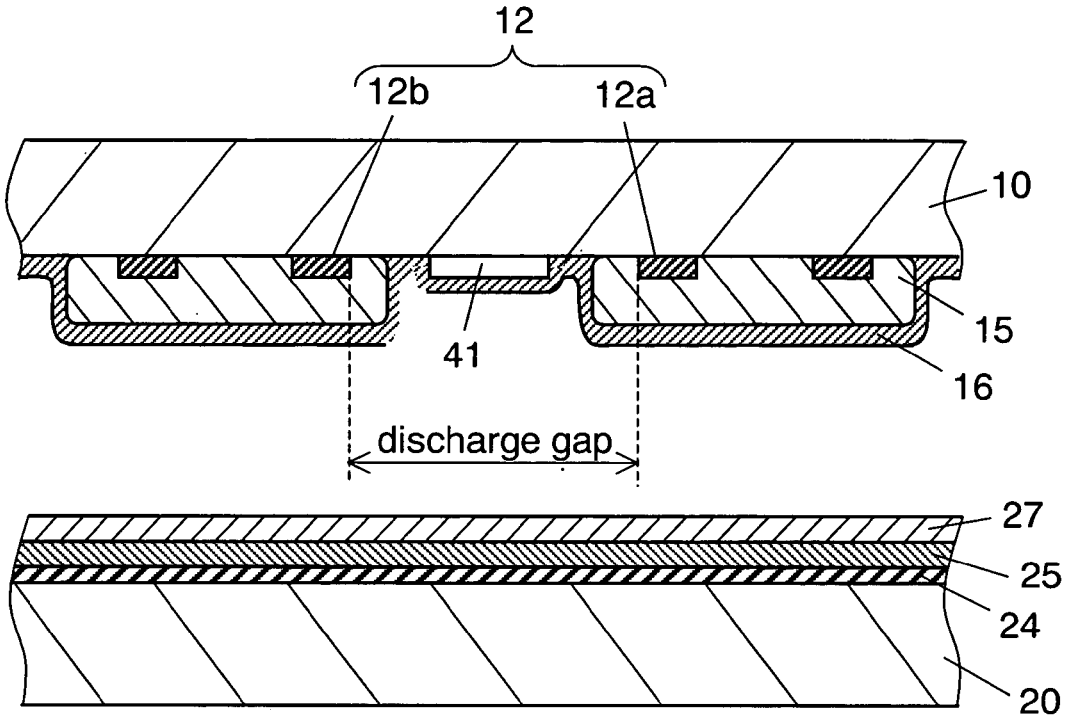
FIG. 5 is a sectional view showing a structure of a plasma display panel in accordance with a second exemplary embodiment of the present invention.
Figure 6:
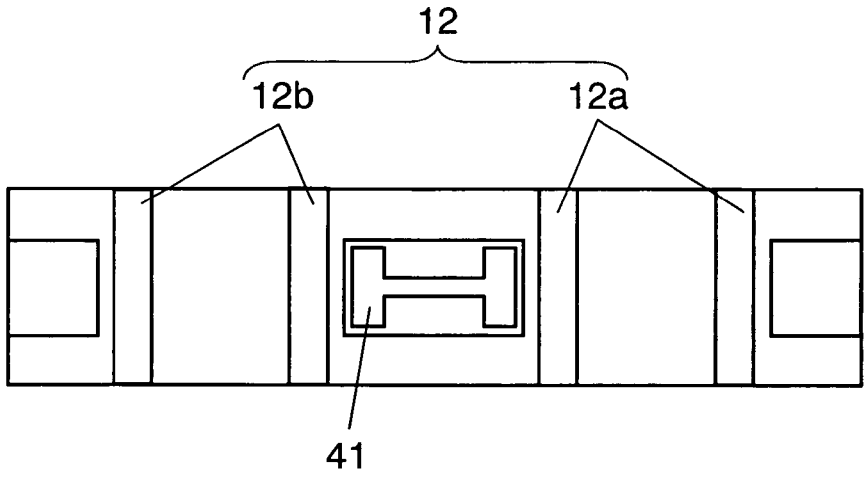
FIG. 6 is a plan view showing the structure of the plasma display panel in accordance with the second exemplary embodiment of the present invention.

FIG. 5 is a sectional view showing a structure of a plasma display panel in accordance with the second exemplary embodiment of the present invention. FIG. 6 is a plan view showing the structure of the plasma display panel in accordance with the second exemplary embodiment of the present invention. The plasma display panel in the second embodiment is identical with that in the first embodiment in that a discharge gap formed between display electrodes 12*a* and 12*b* is not covered with dielectric layer 15. However, the plasma display panel in the second embodiment differs from that in the first embodiment in that float electrode 41, which is electrically insulated from display electrodes 12, is formed at the discharge gap where dielectric layer 15 is not formed. Protective layer 16 is formed in a manner to cover float electrode 41 and dielectric layer 15.

Float electrode 41 is made of electrically conductive material, such as an $SnO_2$ layer or an ITO layer, which is transparent to visible light. Float electrode 41 is designed by combining narrow lines in a manner that its resistance increases in a direction where float electrode 41 crosses display electrodes at right angles and in a manner that portions facing display electrodes 12*a* and 12*b* become long. As shown in FIG. 6 of the second embodiment, the float electrode is designed in an H shape, and a resistance value in the direction where the float electrode crosses display electrodes at right angles is designed to be a considerably high value, i.e., 10–100 MΩ. A line width of the float electrode is designed to be 50–100 μm. In addition, a distance between float electrode 41 and display electrode 12*a* or 12*b* is designed to be considerably short as compared with a distance between electrodes at the discharge gap, and designed to be 60 μm in the second embodiment.

When a voltage is applied to display electrodes 12*a* and 12*b* of the plasma display panel in the second embodiment, an electric field concentrates on two gaps formed of float electrode 41 and display electrode 12*a* or 12*b*, because electrically conductive float electrode 41 is formed at the discharge gap. Therefore, substantial distance of the discharge gap becomes not 500 μm but 120 μm (2×60=120), whereby the discharge-starting voltage considerably decreases. However, when discharge begins, an electric current hardly flows in float electrode 41 because the resistance value of float electrode 41 is high. Thus, the discharge is executed at the discharge gap. As a result, the substantial discharge gap becomes larger in discharging, and luminous efficiency improves. In other words, a plasma display panel with a low discharge-starting voltage and a high luminous efficiency can be realized.

The shape or resistance value of the float electrode discussed above is optimized according to a shape of a discharge cell, a discharge current, a driving voltage and the like of the plasma display panel in the second embodiment. Therefore, when the condition mentioned above is different, the float electrode is required to be optimized according to the different condition.

Figure 7A:
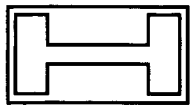
FIG. 7 shows examples of various float electrodes of the plasma display panel in accordance with the second exemplary embodiment of the present invention.
Figure 7C:
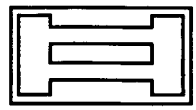
Figure 7B:
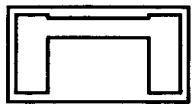
Figure 7D:
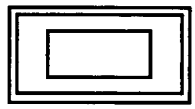
Figure 8:
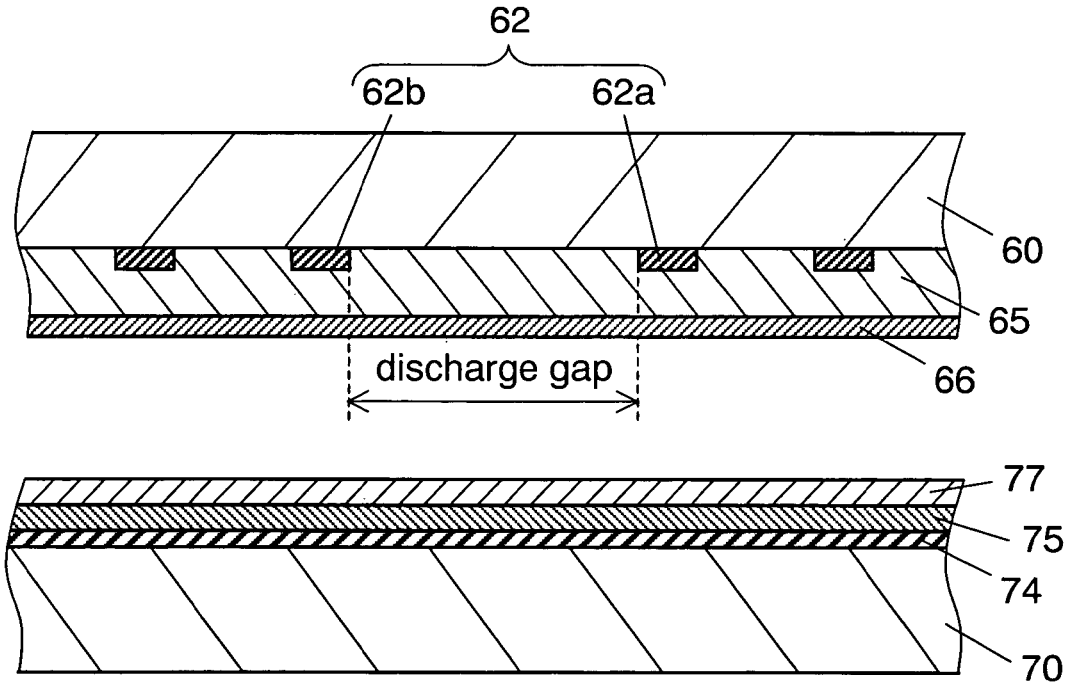
FIG. 8 is a sectional view of a conventional plasma display panel with high luminous efficiency.

Float electrode 41 in an H shape is described in the second embodiment, however, the shape of the float electrode is not limited to this shape. FIG. 7 shows examples of various float electrodes of the plasma display panel in accordance with the second embodiment. FIG. 7A shows the identical H shape shown in FIG. 6. FIG. 7B is one of the possible variations of FIG. 7A and shows an electrical conductive film, which is decentered and formed on a substrate. FIG. 7C shows a central electrically conductive film formed of two narrow lines. A yield of production against breaking lines can be considerably improved using such a plurality of narrow lines. FIG. 7D is one of the possible variations of FIG. 7C.

Float electrode 41 is transparent to visible light and is formed of narrow lines, whereby the visible light irradiated from the phosphor layer is not prevented by float electrode 41 and is transmitted to the front of the plasma display panel. In other words, brightness is not reduced by float electrode 41.

A plasma display panel with high brightness and high luminous efficiency can be provided using this invention.

What is claimed is:

1. A plasma display panel comprising:

a plurality of cells;

a first substrate;

a display electrode comprising plural parallel-disposed electrodes disposed parallel to each other on said first substrate so as to form a discharge gap between two of the plural parallel-disposed electrodes for emitting light for display;

a dielectric layer covering said first substrate and said display electrode and not covering at least part of said discharge gap in each cell;

a plurality of transparent float electrodes, disposed in said cells, respectively, at said at least part of said discharge gap not covered by said dielectric layer, wherein said float electrodes are electrically insulated from said display electrode in every cell of the display panel, the float electrode in each cell is separated from the float electrode in the other cells, and a resistance of each transparent float electrode is higher in areas of the float electrode that are closer to said parallel-disposed electrodes;

a protective layer covering said dielectric layer, said float electrodes, and said at least part of said discharge gap not covered by said dielectric layer;

a second substrate, wherein said display electrode on said first substrate faces said second substrate; and a plurality of data electrodes disposed, for each cell, respectively, on said second substrate, facing said first substrate, and oriented to cross said parallel-disposed electrodes of said display electrode.

2. A plasma display panel according to claim 1, wherein said float electrode is H-shaped.

3. A plasma display panel according to claim 1, wherein said float electrode is rectangular.

4. A plasma display panel according to claim 1, wherein said float electrode has a shape of a variation of an H-shape.

5. A plasma display panel according to claim 1, wherein said float electrode has a shape of a variation of a rectangle.

6. A plasma display panel comprising:

a plurality of cells;

a first substrate;

a display electrode comprising plural parallel-disposed electrodes disposed parallel to each other on said first substrate so as to form a discharge gap between two of the plural parallel-disposed electrodes for emitting light for display;

a dielectric layer covering said first substrate and said display electrode and not covering at least part of said discharge gap in each cell;

a plurality of transparent float electrodes, disposed in said cells, respectively, at said at least part of said discharge gap not covered by said dielectric layer, wherein said float electrodes are electrically insulated from said display electrode in every cell of the display panel, the float electrode in each cell is separated from the float electrode in the other cells, and a resistance of each transparent float electrode is 10–100 MΩ;

a protective layer covering said dielectric layer, said float electrodes, and said at least part of said discharge gap not covered by said dielectric layer;

a second substrate, wherein said display electrode on said first substrate faces said second substrate; and a plurality of data electrodes disposed, for each cell, respectively, on said second substrate, facing said first substrate, and oriented to cross said parallel-disposed electrodes of said display electrode.

7. A plasma display panel according to claim 6, wherein said float electrode is H-shaped.

8. A plasma display panel according to claim 6, wherein said float electrode is rectangular.

9. A plasma display panel according to claim 6, wherein said float electrode has a shape of a variation of an H-shape.

10. A plasma display panel according to claim 6, wherein said float electrode has a shape of a variation of a rectangle.

* * * * *